United States Patent [19]

Roccaforte

[11] 4,360,107

[45] Nov. 23, 1982

[54] CARTON BLANK AND CARTON FOR PIZZA

[75] Inventor: Harry I. Roccaforte, Western Springs, Ill.

[73] Assignee: Champion International Corporation, Stamford, Conn.

[21] Appl. No.: 191,345

[22] Filed: Sep. 26, 1980

[51] Int. Cl.[3] ..... B65D 5/54

[52] U.S. Cl. ..... 206/626; 206/620; 229/33; 229/DIG. 14; 426/113; 426/122

[58] Field of Search ..... 426/113, 114, 122; 206/634, 626, 620; 229/33, DIG. 14

[56] References Cited

U.S. PATENT DOCUMENTS

| | | | |
|---|---|---|---|
| Re. 29,185 | 4/1977 | Tolaas | 426/113 |
| 1,876,120 | 9/1932 | Wilson | 206/628 |
| 2,085,680 | 6/1937 | Grace, Jr. | 229/33 |
| 3,111,255 | 11/1963 | Skowronski | 206/628 |
| 3,861,576 | 1/1975 | Tolaas et al. | 426/113 |
| 4,096,948 | 6/1978 | Kuchenbecker | 426/113 |
| 4,228,945 | 10/1980 | Wysocki | 426/113 |
| 4,260,060 | 4/1981 | Faller | 426/113 |
| 4,279,374 | 7/1981 | Webinger | 426/113 |

*Primary Examiner*—Stephen P. Garbe
*Attorney, Agent, or Firm*—Evelyn M. Sommer

[57] ABSTRACT

A carton erected from a one-piece paperboard carton blank permits a frozen pizza to be heated in a microwave oven while still in the carton. The carton has a bottom panel in contact with the pizza crust, the bottom panel having openings to permit venting of steam vapor during heating and the openings forming cross-straps to support the crust. The openings are sealed by a closure panel prior to heating and portions of the closure panel open like shutters on a window and are used, during heating, to support the carton above the oven shelf.

12 Claims, 4 Drawing Figures

CARTON BLANK AND CARTON FOR PIZZA

BACKGROUND OF THE INVENTION

A pizza is a food product of Italian origin, generally having a leavened dough base in the form of a flat disc with raised edges and having the upper face of the disc covered with a tomato paste and a meltable cheese. The pizza may have other ingredients, such as onions, mushrooms, salami slices, green peppers, etc. on top of the cheese. Some pizzas, called "Sicilian", are rectangular in shape, when viewed from above. A slice of pizza is generally called a "wedge". The pizza may be prepared by a food processor, frozen by the processor, packed in a cardboard box and sold,, at retail, in its frozen state. The user may simultaneously unfreeze and heat the pizza in a microwave oven. A microwave oven produces radio frequency energy which excites the molecules of the pizza and internally and rapidly heats it.

The user may, in some cases, remove the pizza from the cardboard container before placing the pizza in the oven. However, this may be difficult since the pizza crust may be partially frozen to the cardboard. More importantly, the crust may flake or the cheese may run over the rim of the pizza, requiring the oven to be cleaned. Since one of the major attractions of frozen pizza to the user is its convenience, the requirement to clean the microwave oven seriously detracts from that convenience.

Alternatively, the user may retain the pizza in the cardboard container and place both in the microwave oven if the container is small enough to fit in the oven, for example, if the container contains a slice of a large pizza or a small pizza. Retaining the pizza in the container during heating prevents soiling of the oven and permits the pizza to become unfrozen from the cardboard.

However, various problems may occur when the pizza is heated in its cardboard container. The pizza, especially if it has been frozen, contains a considerable amount of moisture. That moisture, under the rapid heating of the microwave oven, may turn into steam vapor. If the vapor cannot rapidly escape from the container, it may make the pizza crust moist and soggy, contrary to its desired property of crispness. In addition, if the bottom crust of the pizza is left in contact with the cardboard during heating, the crust may not be heated sufficiently or it may be heated unevenly or it may become soggy instead of becoming crisp.

U.S. Pat. No. 3,876,131 entitled "Wedge Shaped Carton", which names William Tolaas as inventor and Hoerner Corporation as assignee, shows a carton adapted to hold a frozen slice (wedge) of pizza. The carton has apertures in its bottom panel to permit the circulation of air during heating. The apertures are sealed by a strip of plastic film which is removed prior to heating. The carton bottom, during heating, is kept above the metal panel of the oven by means of the carton's side walls which extend below the level of the carton bottom.

FEATURES AND OBJECTIVES OF THE INVENTION

It is an objective of the present invention to provide a paperboard container for a pizza, or a slice thereof, which is to be heated in a microwave oven, which container permits the pizza to be heated while in the container, permits even heating of the crust without the crust sticking to the container and permits minimal contact between the pizza crust and the carton.

It is a further objective of the present invention to provide such a container which may be partially opened by the user, prior to heating the pizza, to leave only a minimal amount of paperboard material in contact with the bottom crust of the pizza.

It is a further objective of the present invention to provide such a container which does not require that a plastic film be removed from apertures before the pizza is heated.

It is a further objective of the present invention to provide such a container which may be easily and readily manipulated by the user to vent the container before the pizza is heated.

It is a further objective of the present invention to provide such a container which may be produced employing conventional machinery and methods and using a one-piece paperboard blank.

It is a feature of the present invention to provide a carton to contain a frozen pizza and a paperboard carton blank adapted to be erected into such a carton. The pizza may be heated while in the carton. The carton blank comprises a bottom panel having a plurality of openings, for example, four, of sufficient size to vent the pizza while it is being heated and permit minimal contact of the carton with the pizza crust. A first side panel is connected to the bottom panel by a fold line and a top panel is connected to the first side panel by a fold line. A second side panel is connected by a fold line to the top panel and a closure panel is connected to the second side panel by a fold line.

The closure panel includes, as portions thereof, a first and a second openable panel member. The openable panel members are formed by tear lines and fold lines and they are adapted to cover the openings in the bottom panel after assembly of the carton. A plurality of pairs of flaps are connected by fold lines at opposite sides of the panels to form closed carton ends. The blank also includes adhesive means to bond areas of the bottom panel to areas of the closure panel (outside of the openable panel members).

The carton blank may be erected into a carton, filled with a pizza and closed. When the pizza is to be heated, the openable panel members may be lifted from the bottom panel and will support the carton in a raised position in the oven.

BRIEF DESCRIPTION OF THE DRAWINGS

Other objectives and features of the present invention will be apparent from the following detailed description of the invention, which should be taken in conjunction with the accompanying drawings.

In the drawings.

DETAILED DESCRIPTION OF THE INVENTION

Figure 1:
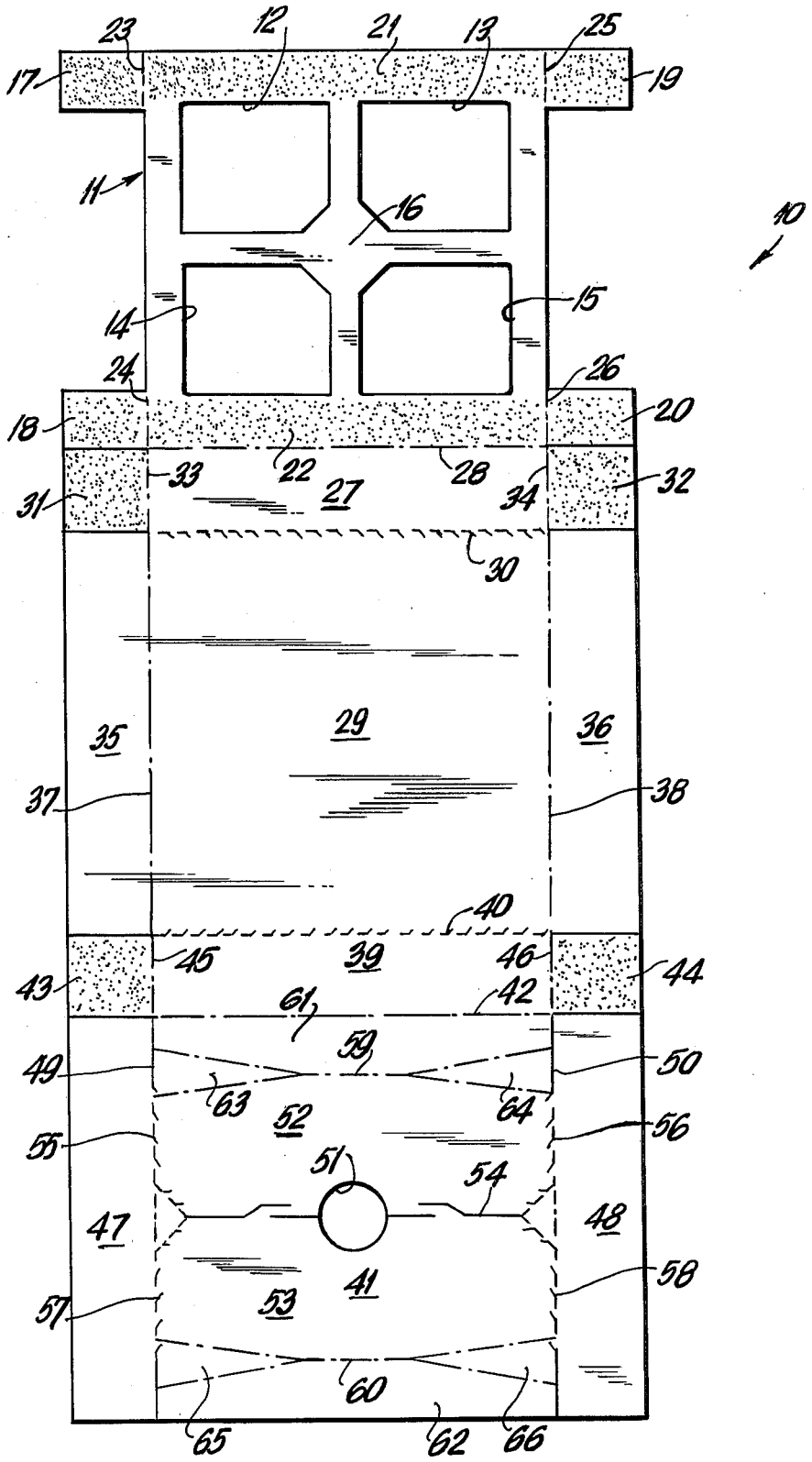
FIG. 1 is a top plan view of the paperboard blank of the present invention.

The blank 10, from which the carton (container) is erected, is shown in FIG. 1. The blank 10 is a one-piece paperboard blank which may be formed, for example, from cardboard, using conventional die-cutting machinery.

The blank 10 comprises a first rectangular panel 11 having four openings 12–15 symmetrically arranged about its center portion 16. The openings 12–15 are preferably large compared to the size of the panel, so that there is minimal contact between the pizza crust and the carton while the pizza is being heated. The four openings 12–15 form four straps joined at, and supporting, the center portion 16.

The first panel 11 has four end flaps. One pair of end flaps 17,18 are connected to the first panel by respective fold lines 23,24 and the other pair of end flaps 19,20 are connected to the panel 11 by respective fold lines 25,26. The end flap 17 is opposite the end flap 19 and similarly the end flap 18 is opposite the end flap 20.

The panel 11 is connected to a first rectangular side panel 27 by a fold line 28. The first side panel 27 is connected to the top panel 29, a rectangular panel, by a score line (tear line) and fold line 30.

The first side panel 27 has opposite end flaps 31,32 connected to it at its opposite sides by respective fold lines 33,34. Similarly, the top panel 29 has opposite side flaps 35,36 connected to it at its opposite sides by respective fold lines 37,38.

The top panel 29 is connected to the second side panel 39 by score line and fold line 40. The second side panel is connected to the closure panel 41 by the fold line 42.

The second side panel 39 has opposite end flaps 43,44 connected to it at its opposite sides by respective fold lines 45,46. Similarly, the closure panel 41 has opposite side flaps 47,48 connected to it at its opposite sides by respective fold lines 49,50.

Figure 2:
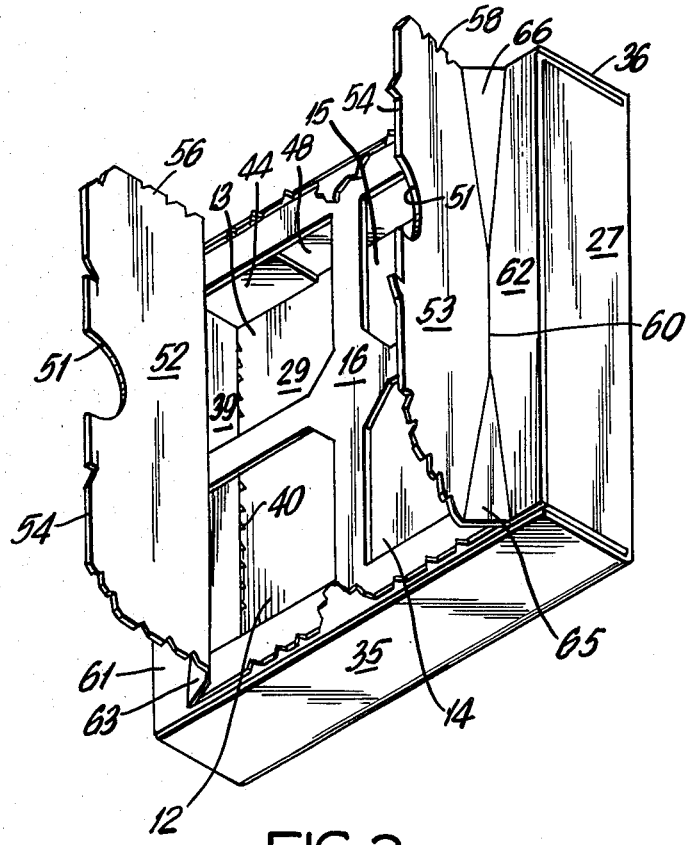
FIG. 2 is a perspective view of the carton of the present invention erected from the blank of FIG. 1 and after its bottom panel members have been opened.

The closure (cover) panel 41 has a central opening 51 which is round in shape. The closure panel 41 has two openable panel members 52,53 which are openable like shutters on a window. The panel member 52 is formed by score line 54 (break-away or tear line) on both sides of opening 51 and opposite score lines 55,56. Similarly, panel member 53 is formed by score line 54 and opposite score lines 57,58. The panel members 52,53 are connected by respective fold lines 59,60 to the remainder of the panel closure 41. The fold lines 59,60 at each of their ends are divided to form respective triangular fold areas 63,64 formed by fold lines. The fold lines forming the triangular fold areas 63,64 and 65,66 make the panel members 52,53 sufficiently springy, i.e., resilient, so that the opened panel members may support the carton, see FIG. 2. The triangular fold areas help stabilize the carton so that its weight may be more positively supported. Another important advantage of the triangular fold areas 63–66 is that they help separate the pizza crust from the bottom panel by bowing out the straps of the bottom panel when the panel members 52,53 are lifted by the user.

The carton is erected and partially glued before the pizza is placed within it. For that purpose the carton blank 10 has glue (adhesive) areas, shown by speckled areas in the drawing, on the top surface of the flaps 31,32, 43 and 44. In addition, there are glue areas on both faces of the flaps 17–20, the glue areas on the undersides of the flaps 17–20 not being shown in FIG. 1.

The glue area 21 on panel 11 is adhered to the strip 61, which is an elongated area of closure panel 41 along fold line 42 and on the top surface of panel 41. Similarly, the glue area 22 on panel 11 is adhered to the elongated strip 62 on the top surface of closure panel 41.

The carton may be shipped in a flat state, ready for erection and insertion of the pizza, by bonding the areas 21,22 of panel 11 to their respective strips 61,62 of closure panel 41.

The carton is erected, from its flat state, at the location where the pizza is to be inserted. To erect the carton, the side panels 27,39 are placed perpendicular to the top panel 29 and one end closed, for example, by bonding flaps 17,18, 31 and 43 to the flaps 35,47. The pizza is inserted, with its bottom lying on the bottom surface of the bottom panel 11, and the open end of the carton is then closed, by bonding the flaps 19,20, 32,44 to the flaps 36,48.

The pizza is kept in the closed carton until it is to be heated. When the pizza is to be heated, the user inserts her fingers in the opening 51 and lifts the openable panel members 52,53 by separating the panel members 52,53 along their score lines 54,55,56 and 54,57,58 respectively.

The carton is then placed in the oven. The pizza is lifted above the oven shelf because it rests on the opened, and spread out, panel members 52,53, see FIG. 2. The vapor may escape through the openings 12–15, which openings were uncovered when the panel members 52,53 are lifted from the bottom panel 11.

Figure 3:
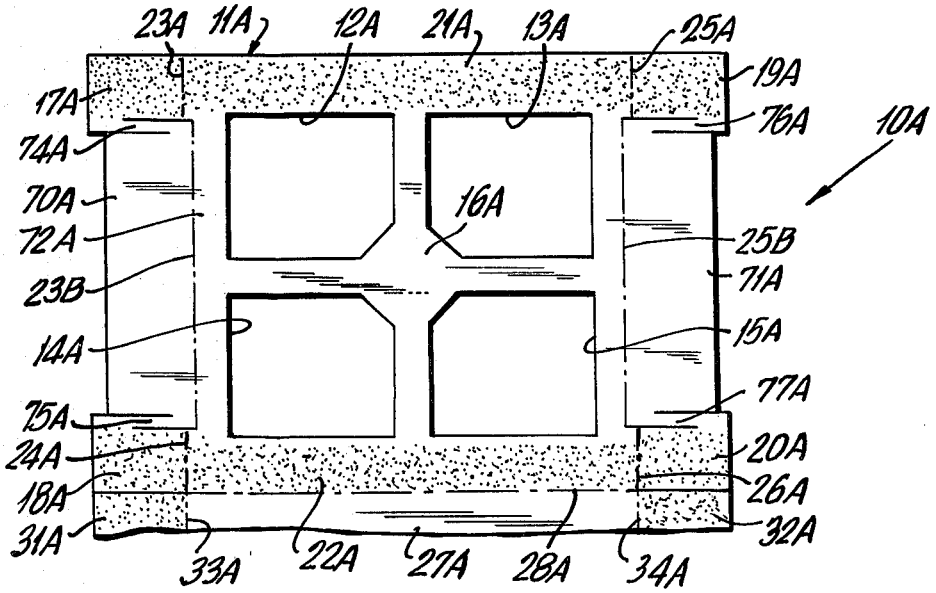
FIG. 3 is a top plan view of a portion of an alternative embodiment of a paperboard blank.

An alternative embodiment of a portion of the paperboard blank is shown in FIG. 3, in which parts which are the same as in FIG. 1 are labeled with the same numbers and have the suffix "A".

In the embodiment of FIG. 3, a stronger carton structure is provided by utilizing additional flap portions 70A, 71A which are between, and join, the respective pairs of flaps 17A, 18A and 19A, 20A. The flap portions 70A, 71A add strength to the respective straps 72A, 73A of the bottom panel 11A to which they are connected. The pressure caused by the overimposition of the two outer flaps, when the ends of the carton are closed, is relieved by offset fold lines 23B and 25B and a pair of two parallel cuts defining a small strap area at each end of the flaps 70A, 71A. The small strap area between the pair of cuts 74A and the pair of cuts 75A, in the case of flap 70A, and the pair of cuts 76A and the pair of cuts 77A in the case of flap 71A, will buckle as the two over-imposed flaps 47 and 48, respectively, are folded over the flaps 70A, 71A, respectively, to close the ends of the carton. The flaps 47 and 48 will seat better if provided with additional pressure relieving cuts in fold lines 49 and 50 (not shown).

Figure 4:
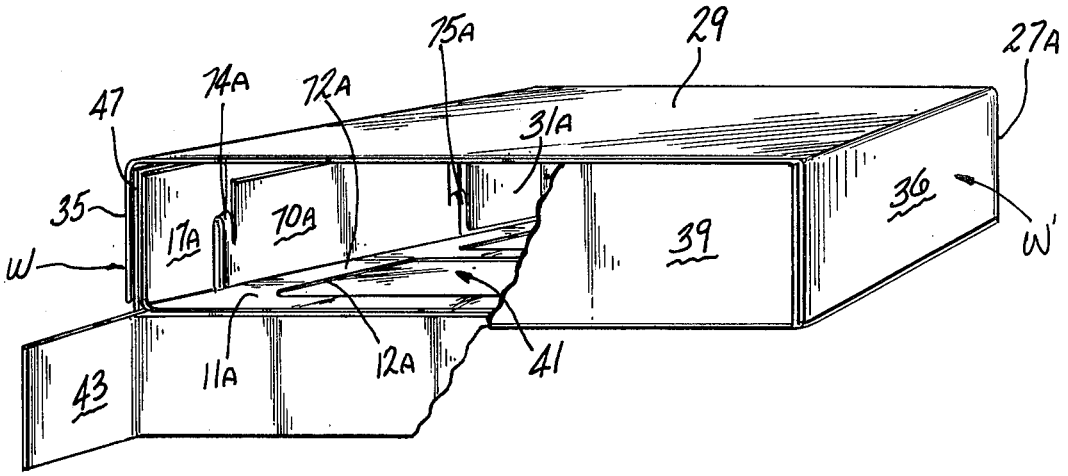
FIG. 4 is a perspective view of an erected carton showing the wall structure formed by the alternative embodiment of the blank shown in FIG. 3.

Referring now to FIG. 4, there is shown the wall structure formed by the blank of FIG. 3 when erected into a carton. The erected carton has a top wall 29, a bottom wall 11A, a panel closure 41, and side walls and flaps 35, 36, 39 and 27A. The strengthened side wall W is formed by upfolding the side flap 47 and sandwiching it between the outer side flap 35 and the inner flaps 17A and 18A (the latter of which is not visible in FIG. 4, but is disposed beneath flap 31A). The inner flap 17A is overlain by flap 43 connected to side wall 39. The flaps 35, 47, 17A and 43 are all adhesively secured together. The flap portion 70A between the parallel cuts 74A and 75A is not secured to the flap 47, and the flap portion 70A supports the strap 72A to which it is foldably connected. With the flaps 17A and 18A secured to the flap 47, and the flap portion 70A free of securement to the flap 47, the strap areas formed by the parallel cuts 74A and 75A, along with the flap portion 70A are free to buckle or flex, as shown in FIG. 4 to relieve stresses caused in the multi flap walls. It will be understood that the side wall W' is formed in a similar manner.

Since many changes and variations of the disclosed embodiments of the invention may be made without departing from the inventive concept, it is not intended to limit the invention otherwise than as required by the appended claims.

What is claimed is:

1. A paperboard blank adapted to be erected into a carton for containing a food product to be heated while in the carton, said blank comprising:

(a) a bottom panel having a plurality of openings therein operative to vent the food product while being heated in the carton;

(b) a first side panel foldably connected to one edge of said bottom panel;

(c) a top panel foldably connected to one edge of said first side panel;

(d) a second side panel foldably connected to one edge of said top panel;

(e) a closure panel foldably connected to one edge of said second side panel so as to overlie said bottom panel openings when the carton is erected; and (f) a plurality of support panels formed in said closure panel, said support panels being foldably connected to marginal portions of said closure panel by a plurality of fold lines forming triangular shaped fold areas.

2. The blank of claim 1 wherein said support panels are in part defined by a common rupturable score line extending across a mid portion of said closure panel.

3. The blank of claim 1, further comprising a plurality of end closure flaps foldably connected to opposite end edges of at least two of said top, bottom and closure panels.

4. The blank of claim 3, wherein a pair of end closure flaps are foldably connected to opposite ends of said bottom panel, each of said pair of end closure flaps comprising restricted marginal portions and a central portion with said central portion being separated from each marginal portion by a pair of parallel cuts defining a stress relieving strap on each side of said central portion.

5. A paperboard blank adapted to be erected into a carton, said blank comprising:

(a) a bottom panel;

(b) a first side panel foldably connected to one edge of said bottom panel;

(c) a top panel foldably connected to one edge of said first side panel;

(d) a second side panel foldably connected to one edge of said top panel;

(e) a closure panel foldably connected to one edge of said second side panel;

(f) end closure flaps foldably connected to each end edge of said top, bottom and closure panels; and (g) said end closure flaps on said bottom panel each including a pair of restricted marginal portions and a central portion intermediate said marginal portions, said central portion being separated from each of said marginal portions by a pair of parallel cuts defining a stress relieving strap on each side of said central portion.

6. The blank of claim 5, wherein said central portion is connected to said bottom panel along a fold line which is inwardly offset from and parallel to colinear fold lines connecting said marginal portions to said bottom panel.

7. A paperboard blank adapted to be erected into a carton for containing a food product to be heated while in the carton, said blank comprising:

(a) a bottom panel comprising four marginal straps extending along the edges of said bottom panel, said straps being disposed in opposed parallel pairs with one pair of said straps being disposed perpendicular to the other pair of said straps, and a pair of cross straps disposed perpendicular to each other with each of said cross straps interconnecting a medial portion of one of said marginal straps with the medial portion of the marginal strap parallel thereto, said marginal straps and said cross straps defining four substantially rectangular major openings in said bottom panel for venting the interior of the carton formed from the blank while, at the same time, providing support for a product disposed in the carton;

(b) a first side panel foldably connected to one edge of said bottom panel;

(c) a top panel foldably connected to one edge of said first side panel;

(d) a second side panel foldably connected to one edge of said top panel;

(e) a closure panel foldably connected to one edge of said second side panel so as to overlie said bottom panel openings when the carton is erected;

(f) a plurality of end closure flaps foldably connected to opposite end edges of said top panel and said closure panel; and (g) rupturable means forming a pair of support panels in said closure panel, said support panels being foldable out of the plane of said closure panel to uncover said bottom panel openings when the carton is erected.

8. A paperboard carton for containing a food product to be heated while in the carton, said carton comprising:

(a) top and bottom panels spaced apart and generally parallel to each other;

(b) means defining spaced apart side walls extending between respective side edges of said top and bottom panels;

(c) means defining spaced apart end walls extending between respective end edges of said top and bottom panels;

(d) means providing a plurality of openings in said bottom panel for venting the food product during heating thereof in the carton;

(e) a closure panel overlying said bottom panel to close said openings;

(f) means defining a plurality of support panels within said closure panel, said support panels directly overlying said openings; and (g) a plurality of fold lines forming triangular shaped fold areas in said closure panel and foldably interconnecting said support panels to the remainder of said closure panel.

9. The carton of claim 8, wherein said means defining said support panels comprises a single rupturable score line extending across a mid portion of said closure panel to define support surface edges on each of said support panels, said single rupturable score line being approximately midway between said triangular shaped fold areas.

10. A paperboard carton in which each member of a pair of flaps is foldably connected to a respective one of a pair of panels, said flaps being disposed in face-to-face relation with each other and said panels being disposed in face-to-face relation with each other, said flaps having adjacent parallel fold lines foldably connecting them to their associated panel, one of said pair of flaps further having end portions defined by two pairs of parallel cuts in said one of said flaps, said end portions being secured to the other of said pair of flaps in face-to-face relation, and a mid portion between said end portions and pairs of cuts being left unsecured to permit relative movement between said flap portions upon stress-relieving buckling of strap areas between said parallel cuts when said flaps are folded perpendicular to said panels.

11. The carton of claim 10 in which the relative movement comprises movement of said mid portion of said flap and said strap areas between said parallel cuts to relieve stress on the material created by folding at said fold lines.

12. The carton of claim 10 wherein the fold line of said one of said flaps having said parallel cuts is offset inwardly along said mid portion thereof between said pairs of cuts.

* * * * *